US007387425B2

(12) United States Patent
Dean

(10) Patent No.: US 7,387,425 B2
(45) Date of Patent: Jun. 17, 2008

(54) MOBILE GROUT PLANT

(76) Inventor: Christopher J. Dean, 71 Route 34, Colts Neck, NJ (US) 07722

( * ) Notice: Subject to any disclaimer, the term of this patent is extended or adjusted under 35 U.S.C. 154(b) by 394 days.

(21) Appl. No.: 10/885,153

(22) Filed: Jul. 6, 2004

(65) Prior Publication Data

US 2006/0007775 A1 Jan. 12, 2006

(51) Int. Cl.
*B28C 9/04* (2006.01)

(52) U.S. Cl. ..... 366/15; 366/51

(58) Field of Classification Search ..... 366/14–15, 366/50, 19, 20, 290–291, 1–68
See application file for complete search history.

(56) References Cited

U.S. PATENT DOCUMENTS 1,829,479 A * 10/1931 Elkins ..... 425/87
2,104,191 A * 1/1938 Flynn ..... 366/15
2,478,079 A * 8/1949 Beasley et al. ..... 366/156.1
2,538,891 A * 1/1951 Zimmerman et al. .... 366/156.1
3,006,615 A * 10/1961 Mason, Jr. ..... 366/20
3,050,159 A 8/1962 Paulus et al.
3,295,698 A 1/1967 Ross et al.
3,456,925 A 7/1969 Gallagher
4,036,564 A 7/1977 Richards
4,071,226 A 1/1978 Miller
4,117,547 A * 9/1978 Mathis et al. ..... 366/17
4,298,288 A * 11/1981 Weisbrod ..... 366/8
4,406,548 A 9/1983 Haws
4,436,431 A * 3/1984 Strong et al. ..... 366/17
4,506,982 A 3/1985 Smithers et al.
4,586,824 A 5/1986 Haws
4,792,234 A 12/1988 Doherty
4,907,890 A 3/1990 Lepper
5,005,980 A * 4/1991 Zimmerman ..... 366/153.3
5,061,158 A 10/1991 Egli
5,149,192 A 9/1992 Hamm et al.
5,213,414 A * 5/1993 Richard et al. ..... 366/27
5,314,100 A 5/1994 Deaver
5,352,035 A * 10/1994 Macaulay et al. ..... 366/15
5,433,520 A 7/1995 Adams et al.

(Continued)

FOREIGN PATENT DOCUMENTS

DE 4119261 A1 * 12/1992

(Continued)

OTHER PUBLICATIONS

ChemGrout® CG-500 Relates to CG-500 versatile series, date unknown.

(Continued)

*Primary Examiner*—Charles E Cooley
(74) *Attorney, Agent, or Firm*—Hedman & Costigan, P.C.

(57) ABSTRACT

A mobile grout plant for preparing structural grout comprising a mixer having an opening for receiving at least a portion of the components for preparation of the grout, a remixer located downstream of the mixer, a deck and at least one motor to power the mixer and remixer, wherein the mixer is oriented vertically above the remixer and at a terminal end of the grout plant so that a truck with aggregate can back up to the mixer for offloading directly into the mixer, with the opening of the mixer adapted to be about waist height to a worker standing on the deck.

15 Claims, 1 Drawing Sheet

U.S. PATENT DOCUMENTS

| | | | | |
|---|---|---|---|---|
| 5,570,953 | A * | 11/1996 | DeWall | 366/10 |
| 5,730,523 | A | 3/1998 | Flood | |
| 5,752,769 | A * | 5/1998 | Weber et al. | 366/15 |
| 5,785,420 | A * | 7/1998 | Schuff | 366/20 |
| 5,878,921 | A | 3/1999 | Chase et al. | |
| 6,123,445 | A * | 9/2000 | Grassi | 366/20 |
| 6,193,402 | B1 * | 2/2001 | Grimland et al. | 366/14 |
| 6,227,813 | B1 | 5/2001 | Leimer | |
| 6,655,107 | B2 | 12/2003 | Dean | |
| 2002/0191481 | A1 * | 12/2002 | Cox et al. | 366/16 |
| 2005/0276152 | A1 * | 12/2005 | Goode et al. | 366/6 |
| 2006/0007775 | A1 * | 1/2006 | Dean | 366/51 |

FOREIGN PATENT DOCUMENTS

| | | | |
|---|---|---|---|
| DE | 4120895 | A1 * | 1/1993 |
| GB | 2098497 | A * | 11/1982 |
| JP | 10-100133 | * | 4/1998 |

OTHER PUBLICATIONS

ChemGrout® CG-680 Relates to CG-680 high capacity colloidal mixer series, date unknown.

ChemGrout® CG-600 Relates to CG-600 colloidal series, date unknown.

* cited by examiner

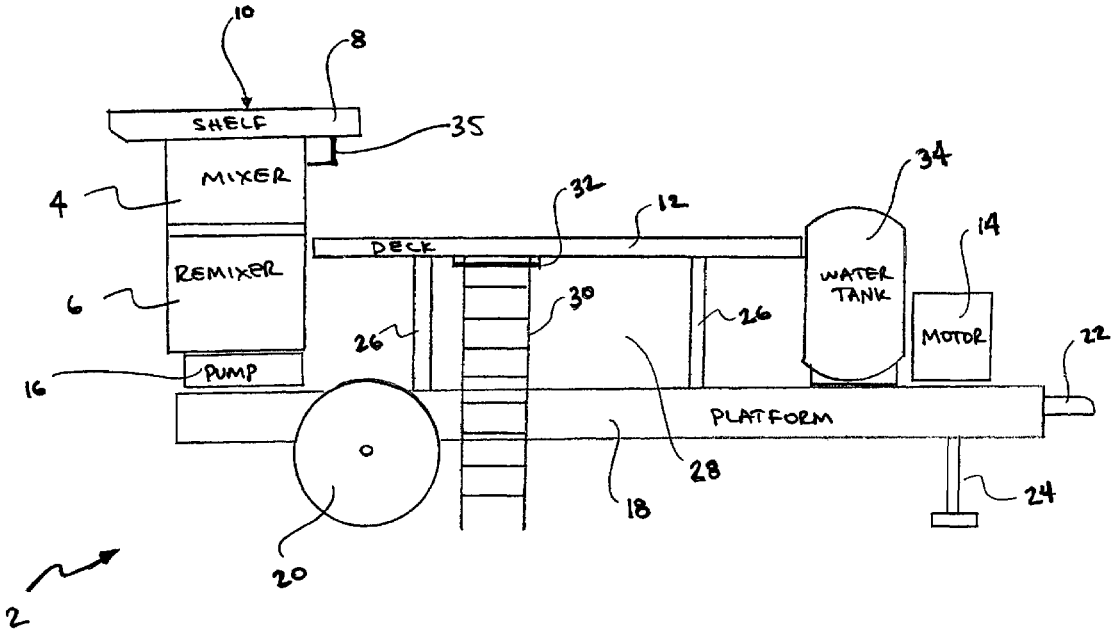
10
8
SHELF
35
MIXER
4
32
12
34
DECK
14
REMIXER
6
30
26
26
WATER TANK
MOTOR
22
16
PUMP
PLATFORM
28
18
24
20
2

MOBILE GROUT PLANT

FIELD OF THE INVENTION

The present invention relates to a mobile plant for the preparation of structural grout at a job site. More particularly, the invention relates to an arrangement of components for the efficient, virtually continuous preparation and holding of prepared structural grout at a job site for use on an as needed basis.

BACKGROUND OF THE INVENTION

Construction jobs, such as the building or repair of foundations, facings, etc., often require the use of large amounts of structural grout. One example of such a job is the reinforcing of hollow concrete block walls, as described in U.S. Pat. No. 6,655,107, dated Dec. 2, 2003.

These types of jobs are generally done over a period of time, with the need for prepared grout being everywhere from virtually continuous to often interrupted over the duration of the job. For these jobs, the grout must be available when needed, so that the workers are not waiting for grout, but also such that the grout is not sitting so long as to set prior to use.

Preparation of structural grout at the job site requires having the components for making the grout available at the site for workers to mix. These components are well known in the art and generally include a Portland cement, an aggregate such as sand and water. When mixed at a job site, the grout is generally prepared in batches of about one-half cubic yard each, based on the prepackaged nature of Portland cement generally used that comes in bags of about 94 pounds.

Although such batches can be mixed individually in tubs or mixers, they must then be used quickly after mixing stops to avoid setting prior to use. To accomplish this, a batch of structural grout that has been prepared but cannot be used quickly must be continuously mixed so that it will not set. On the other hand, to ensure that workers are not standing idle waiting for more prepared grout to continue a job, another batch must always be prepared and ready for use.

Based on these requirements, efforts have been made to prepare grout more efficiently at the job site. These have included grout stations comprising a mixer for mixing the grout components, a hopper with an auger or agitator for maintaining the mixed grout in a usable state, a motor to run the mixer and agitator and a pump to move the grout to the location where it is being used. Several examples of such grout stations with the components mounted on a skid for mobility are CHEMGROUT® models CG-500, CG-600 and CG-680.

Other mobile plants used for mixing concrete or other such materials comprised of components mixed at a job site have been described for use at the site. Examples include U.S. Pat. No. 4,071,226, directed to a transporting vehicle having separate hoppers for the components to be mixed that discharge to a conveying and mixing trough; U.S. Pat. No. 5,785,420, directed to a trailer having a hopper divided into compartments for the components and a conveyer to convey the components to a mixer; U.S. Pat. No. 4,907,890, directed to a portable mixing device with an upper frame for a hopper which drops dry ingredients onto a conveyer which deposits the ingredients into a mixer where water is introduced; and U.S. Pat. No. 4,506,982, directed to a trailer for continuously blending a viscous liquid having hydraulically driven pumps and motors to feed the viscous liquid and solids to a blending chamber.

However, the prior art does not provide a mobile device that meets the demands encountered when a supply of grout is required on an as needed basis. In this regard, there is a need for a device that can provide grout at a job site on an as needed basis, which can be easily and efficiently operated by a limited number of workers.

SUMMARY OF THE INVENTION

These and other objects are achieved by the present invention, directed to a mobile grout plant for preparing structural grout comprising a mixer having an opening for receiving at least some of the components for preparation of the grout, a remixer located downstream of the mixer, a deck and at least one motor to power the mixer and remixer, wherein the mixer is oriented at a terminal end of the grout plant, vertically above the remixer, and the opening of the mixer is adapted to be about waist height to a worker standing on the deck.

The preferred grout plant further includes a pump to deliver the prepared grout from the remixer to the work area where the grout is needed and a water tank to hold the water needed to prepare the grout. Most preferably, the water from the tank is measured by an auto fill/shut off valve such that the amount of water delivered to the mixer can be regulated without user error.

A shelf associated with the opening on the mixer for resting at least some of the component materials at the location of the opening prior to delivery into the mixer is also preferred. A worker can thus rest a bag of Portland cement or the like on the edge of the mixer opening prior to splitting the bag and emptying its contents into the mixer.

It is also preferred that the motor for powering the mixer and/or remixer be located at an area away from the mixer to limit the noise level in the area of the mixer where a worker will be spending the majority of his time. It is further preferred that the motor be a hydraulic motor that powers the mixer and remixer, as well as the pump when used with the present invention.

Other preferred features of the present invention include a stow away ladder for a worker to access the deck and a platform, preferably located beneath the deck, on which bags of material such as Portland cement can be transported to the job site and stored until needed.

It is also preferred that the mixer be located at a terminal end of the grout plant so that a truck containing aggregate for making the structural grout can be moved into position along side of the mixer and the aggregate delivered directly into the mixer. In this regard, it is preferred that the height of an opening into the mixer for delivery of the aggregate is at about waist height to the bed of the truck on which the aggregate is delivered.

To achieve the delivery of aggregate directly from a truck to the mixer opening, and ease the delivery of Portland cement to the mixer opening as set forth above, the deck height is adapted to be about the height of the truck bed. As such, the truck with the aggregate can be backed up to the terminal end of the grout plant on which the mixer is located for delivery of the aggregate to the mixer at virtually the same time that the Portland cement is being delivered to the mixer.

BRIEF DESCRIPTION OF THE DRAWING

The present invention will be better understood when considered in view of the attached drawing, presented merely to illustrate the preferred embodiment of the present invention without limiting the invention in any manner whatsoever.

The figure is a schematic view of the preferred embodiment of the mobile grout plant, in accordance with the present invention.

DETAILED DESCRIPTION OF THE PREFERRED EMBODIMENT

With reference to the appended drawing, the preferred embodiment of the mobile grout plant 2 of the present invention comprises a mobile structure that can be moved to a job site for preparing structural grout. Although the grout plant 2 can be incorporated onto a dedicated vehicle, such as on the bed of a truck or the like, it is shown as formed on a trailer that can be hitched to a vehicle and towed to a job site.

To prepare the structural grout, the grout plant 2 utilizes a mixer 4 for mixing the components of the grout, most preferably a Portland cement, an aggregate, such as sand, and water. To ensure that the grout is available when making a new batch and does not begin to set if the prepared grout is not used quickly enough, a remixer 6 is associated with the mixer 4. The mixer 4 is oriented at a terminal end of the grout plant 2, vertically above the remixer 6, to allow prepared grout to move from the mixer 4 to the remixer 6 by gravity feed.

A pump 16 is preferably oriented vertically below the remixer 6, for pumping the prepared structural grout to the work area where it is to be used, so that the pump 16 is gravity fed grout from the remixer 6. A grout hose (not shown) can be attached to the pump 16 for selectively directing the grout to the particular work area at the job site without having to move the grout plant 2.

The mixer 4, remixer 6 and pump 16 can be powered individually or collectively by any known means, such as by one or more conventional gas, electric or hydraulic motors. It is preferred, however, to utilize a motor that powers more than one of the components, and preferably a single motor 14 that powers the mixer 4, the remixer 6 and the pump 16. In the preferred most preferred embodiment, the single motor 14 is preferably a hydraulic motor that powers each of the mixer 4, the remixer 6 and the pump 16. It has been determined that a suitable hydraulic motor for this application is model SP20A14A9H2R manufactured by PRINCE.

In the preferred embodiment, the motor 14 for powering the mixer 4, remixer 6 and pump 16 is preferably located away from the mixer 4, where the worker is most often located to feed materials into the mixer 4 for preparing the structural grout. Thus, elevated noise conditions created by the motor 14 are reduced for the worker.

As a feature of the invention, a deck 12 is formed on the grout plant 2 such that a worker has easy access to the opening 10 for feeding the grout component materials into the mixer 4 located in vertical arrangement with the remixer 6 and the pump 16. In the preferred embodiment shown, a shelf 8 is formed adjacent the opening 10 to the mixer 4 so that a worker can rest bags of Portland cement or the like on the shelf 8 for splitting the bags and pouring the material into the opening 10 of the mixer 4. The shelf 8 can extend around the entire opening 10, as shown in FIG. 1, or can be on less than all of the sides of the opening 10 subject to the contemplated method of filling the mixer 4.

The shelf 8, as well as the adjacent opening 10 to the mixer 6, is adapted to be oriented at about waist height to a worker standing on the deck 12 of the grout plant 2. Thus, a worker on the deck 12 can more easily place a bag of Portland cement onto the shelf 8 for delivery of the Portland cement into the opening 10 of the mixer 4. In this regard, the shelf 8 and opening 10 to the mixer 4 are preferably in the range of from about 30 to about 48 inches above the surface of the deck 12.

Moreover, it is generally the practice of workers preparing grout to use bulk aggregate rather than bagged aggregate when preparing significant amounts of grout. The bulk aggregate, which is usually sand, is most often transported to the job site by truck, with the sand piled in the bed of the truck. The sand is then shoveled into the mixer 4 at the job site when preparing the grout.

The opening 10 to the mixer 4 of the present grout plant 2, or an alternative opening for receiving the aggregate if desired (not shown), is also preferably adapted so that it is at about waist height to a worker standing on the bed of a truck containing aggregate for mixing with the Portland cement and water in the mixer 4. In the preferred embodiment using a mixer 4 with a single opening 10 for feeding the Portland cement and sand, the deck 12 is preferably formed at about the height of a truck bed from the ground such that the deck 12 is about even with the truck bed. The opening 10 to the mixer 4 would therefore be at about waist height to both the deck 12 and the truck bed.

For example, it is generally the case that a standard truck bed is about 48 inches from the ground. As such, the deck 12 of the preferred grout plant 2 of the present invention would also be about 48 inches from the ground. The opening 10 of the mixer 4 would therefore preferably be about 84 inches from the ground to correspond to about the waist height of a worker standing on the truck bed delivering the aggregate and the waist height of a worker standing on the deck 12.

As shown in the present Figure, the grout plant 2 of the preferred embodiment is in the form of a trailer that is towed to ajob site, possibly by a truck carrying aggregate for use in preparing the grout. This embodiment includes a platform 18 having two axels with wheels 20 on which the grout plant 2 rolls. A hitch 22 is provided at one end of the grout plant 2 for removable attachment to a vehicle, such as the truck carrying the aggregate. One or more retractable stands 24 permit the grout plant 2 to remain level when the hitch 22 is removed from the vehicle towing the grout plant 2.

The platform 18 of the grout plant 2 is preferably located lower to the ground with the deck 12 covering at least a portion thereof. The deck 12 is maintained in an elevated relation to the platform 18 by supports 26. Thus, it is intended that a space 28 exist between the platform 18 and the deck 12, covering at least a portion of the platform 18, which can accommodate a number of bags of Portland cement or the like for transport to the job site and/or storage prior to use.

Due to the height of the deck 12 from the ground, the preferred embodiment of the present grout plant 2 includes a stowable ladder 30 for a worker to access the deck 12. Although any suitable means for stowing the ladder 30 may be used, a cavity 32 formed below the deck 12 into which the ladder 30 can slide and be secured into place has been found to be suitable.

It is also preferred that the grout plant 2 include its own water supply, in the form of a water tank 34 located on the grout plant 2. Preferably, the water tank 34 is placed on the platform 18 of the grout plant 2 and holds from about 200 to about 225 gallons of water. Most preferably, the water tank 34 maintains a conduit (not shown), such as a hose, for delivery of the water from the water tank 34 directly to the mixer 4 for preparing the grout.

The flow of water through the conduit from the water tank 34 to the mixer 4 is preferably regulated by an automatic timer switch 35 (net-shown), as is known in the art, to minimize human error in determining the amount of water used in preparing the grout. A suitable water pump for the automatic delivery of water to the mixer 4 is the general purpose wash down pump manufactured by RULE.

In this regard, it is preferred that the grout be prepared in standard batches of about one-half (½) cubic yard each. The batch size conforms to about five (5) 94 pound bags of Portland cement, approximately an equal amount of sand and about 25 gallons of water added to the mixer 4. Sometimes a water reducing agent or accelerator is necessary and can be added to the mixer 4 by the worker.

The mixer 4 is preferably a paddle type mixer, as is the remixer 6, paddle type mixers for this application being well known in the art. Once the Portland cement, sand and water are deposited in the mixer 4 the motor 14 is engaged and the grout is prepared therein. After the grout is prepared in the mixer, it is passed by gravity feed to the remixer 6 where it is substantially continuously agitated until it is needed for use at the work area, to ensure that the grout does not prematurely set.

As stated above, the prepared grout is preferably delivered to the work area through a hose (not shown) connected to the pump 16. Although any suitable pump may be used, the pump 16 is preferably a hydraulic piston pump, such as model GP 20/300 manufactured by R.E. RUPE CO.

Of course, variations, modifications and alterations to the preferred embodiment of the present invention described above will make themselves apparent to those skilled in the art. All such deviations to the preferred embodiment described are intended to fall within the spirit and scope of the present invention, limited solely by the appended claims.

All patents referred to herein are hereby incorporated by reference.

I claim:

1. A mobile grout plant for preparing structural grout comprising a mixer having an opening for receiving at least a portion of the components for preparation of the grout, a remixer located downstream of the mixer, a worker deck at a height above the ground, a shelf adjacent at least a portion of the opening of the mixer at the height of the opening and located above the worker deck, a platform located below the worker deck and at least one motor to power the mixer and remixer, wherein the mixer is oriented at a terminal end of the grout plant, vertically above the remixer, and the opening of the mixer is adapted to be at a height of from about 30 to about 48 inches above the deck.

2. The mobile grout plant of claim 1 further comprising a pump to move the prepared grout from the remixer to a work area.

3. The mobile grout plant of claim 2 wherein the pump is located vertically below the remixer.

4. The mobile grout plant of claim 2 wherein the pump is a hydraulic piston pump.

5. The mobile grout plant of claim 1 wherein the deck is adapted to be at a height of about 48 inches from the ground, about the height of a bed of a truck carrying an aggregate for delivery to the mixer.

6. The mobile grout plant of claim 1 further comprising a water tank for transport and storage of water to be used in preparing grout.

7. The mobile grout plant of claim 1 further comprising an automatic timer switch and pump for delivery of water to the mixer.

8. The mobile grout plant of claim 1 wherein a single hydraulic motor powers the mixer and remixer.

9. The mobile grout plant of claim 1 wherein the motor is located on the grout plant in an area away from the mixer.

10. The mobile grout plant of claim 1 further comprising a stow away ladder for accessing the deck.

11. The mobile grout plant of claim 1 wherein grout component materials can be transported and/or stored on the platform.

12. The mobile grout plant of claim 1 wherein the shelf is adapted to be at a height of from about 78 inches to about 96 inches from the ground, about equal to waist height of a worker standing on a bed of a truck containing aggregate to be delivered into the mixer.

13. The mobile grout plant of claim 1 further comprising a plurality of wheels for mobility of the grout plant.

14. The mobile grout plant of claim 13 further comprising a hitch for attaching the grout plant to a vehicle for towing the grout plant to a job site.

15. The mobile grout plant of claim 14 further comprising one or more stands for maintaining the grout plant in a level orientation when it is not hitched to a vehicle.

* * * * *